US006705064B1

(12) United States Patent
Grissom

(10) Patent No.: US 6,705,064 B1
(45) Date of Patent: Mar. 16, 2004

(54) HORSE BIT ASSEMBLY WITH SHANK CLIPS FOR INTERCHANGEABLE MOUTHPIECES

(76) Inventor: Randall L. Grissom, 107 Cascade La., Bell Buckle, TN (US) 37020

( * ) Notice: Subject to any disclaimer, the term of this patent is extended or adjusted under 35 U.S.C. 154(b) by 0 days.

(21) Appl. No.: 10/463,437

(22) Filed: Jun. 18, 2003

(51) Int. Cl.[7] ..... B68B 1/04; B68B 1/06
(52) U.S. Cl. ..... 54/6.1; 54/7
(58) Field of Search ..... 54/6.1, 6.2, 7, 54/8; D30/136

(56) References Cited

U.S. PATENT DOCUMENTS

| | | | | | |
|---|---|---|---|---|---|
| 52,125 | A | | 1/1866 | Baker | |
| 485,638 | A | | 11/1892 | Maddox, Jr. | |
| 1,678,532 | A | * | 7/1928 | Preece | 54/7 |
| 2,342,449 | A | * | 2/1944 | Burgess | 54/6.1 |
| D156,125 | S | * | 11/1949 | Kelly | D30/136 |
| 3,304,692 | A | * | 2/1967 | Lovell, Jr. | 54/7 |
| 3,478,493 | A | | 3/1967 | Welton | |
| 3,670,476 | A | | 6/1972 | Parry | |
| D252,163 | S | | 6/1979 | Johnson | |
| 4,274,246 | A | * | 6/1981 | Stewart | 54/6.1 |
| 5,231,818 | A | | 8/1993 | Newman | |
| 5,357,735 | A | | 10/1994 | Fry | |
| 6,490,848 | B2 | * | 12/2002 | Myler et al. | 54/7 |
| 2003/0009996 | A1 | | 1/2003 | Markle | |

* cited by examiner

*Primary Examiner*—Charles T. Jordan
*Assistant Examiner*—Elizabeth Shaw
(74) *Attorney, Agent, or Firm*—Richard C. Litman

(57) ABSTRACT

The horse bit assembly with shank clips for interchangeable mouthpieces is a horse bit assembly that uses resilient clips to facilitate the quick and easy replacement of the mouthpiece. The assembly includes two shanks, an interchangeable mouthpiece and a curb chain. Each shank has a clip that is adapted to receive a ring-shaped end of the mouthpiece and the curb chain helps maintain the bit assembly in an optimal position on a horse.

11 Claims, 7 Drawing Sheets

HORSE BIT ASSEMBLY WITH SHANK CLIPS FOR INTERCHANGEABLE MOUTHPIECES

BACKGROUND OF THE INVENTION

1. Field of the Invention

The present invention relates to horse bits and, more particularly, to a horse bit assembly having shank clips that enable the bit mouthpiece to be easily removed and replaced.

2. Description of the Related Art

A horse bit is used to communicate with and control a horse by applying pressure to either the horse's tongue or the corners of the horse's mouth. Typically, the bit is held in the horse's mouth by a bridle. The bit has a set of rings to which a set of reins is secured. By skillfully pulling the reins, a rider of the horse can apply pressure to the horse's mouth or tongue in a manner that communicates a command, such as a command to stop or turn.

To accommodate the unique preferences of individual horses, numerous bits of different sizes and shapes are known and are commercially available. Typically, a horse trainer or rider must try several bits before discovering one that a particular horse finds comfortable and to which the horse responds appropriately.

One type of horse bit includes a mouthpiece (sometimes referred to as a port), two cheekpieces or shanks, a set of rings for attachment to the bridle, a set of rings for attachment to the reins, and a curb chain. Each end of the mouthpiece is attached to a cheek shank. Each cheek shank has an upper and lower ring and is positioned along one of the horse's cheeks such that the mouthpiece passes through the horse's mouth. Each end of the curb chain is attached to an upper ring with the chain being secured across the underside of the horse's jaw. Although this type of horse bit is appropriate for many horses, it can be time consuming and expensive to find one with a mouthpiece of a shape and size suitable for a particular horse. Unfortunately, if the horse does not like the mouthpiece then either the mouthpiece must be replaced or the rest of the components will go unused. However, replacing the mouthpiece requires both time and energy to either break it from the shanks and weld in a new mouthpiece, or to remove and replace screws from a cumbersome mouthpiece fastening mechanism.

Conventional bit assemblies usually have a mouthpiece which is fixed to the cheekpieces, i.e., the bit assembly is not designed for interchangeable mouthpieces. Consequently, with this type of bit assembly, the mouthpiece can only be replaced by breaking it from the cheek shanks and then welding in a new mouthpiece. Representative examples of this type of bit are shown in U.S. Pat. No. 52,125 to Baker, U.S. Pat. No. 485,638 to Maddox, U.S. Pat. No. 3,478,493 to Welton, U.S. Des. Pat. No. 252,163 to Johnson, and U.S. Pat. Pub. No. 2003/0009996.

However, to avoid the time-consuming task of changing a mouthpiece on one of these bits, trainers and riders will often incur the expense of maintaining an inventory of these bits with each bit having a different size or shape of mouthpiece.

U.S. Pat. No. 3,670,476 to Parry describes a horse bit with an interchangeable mouthpiece. Each end of the mouthpiece forms a T-shape, with each arm of the "T" adapted to fit into a U-shaped clip that is bolted onto the cheek shank. Although the Parry bit does allow for interchangeable mouthpieces, it has some significant drawbacks. First, the majority of mouthpieces used in other types of bit assemblies, where the mouthpieces can be replaced, typically have a loop or ring at each end. As a result, mouthpieces with T-shaped ends are not as common as those with ring-shaped ends and, therefore, the selection of sizes and shapes of mouthpieces with T-shaped ends is more limited. Second, replacing the mouthpiece requires disassembling four small nut and bolt assemblies and four U-shaped clips which can be time consuming and difficult. Third, and perhaps most significant, if one of the nuts or bolts should come loose and slip into the horse's mouth, it could cause serious discomfort or harm to the horse.

U.S. Pat. No. 5,231,818, issued Aug. 3, 1993 to F. C. Newman, shows a training aid having a chain with a plurality of weights disposed thereon, the chain being clipped at opposite ends to the rings of a snaffle bit. U.S. Pat. No. 5,357,735, issued Oct. 25, 1994, discloses bits which are adjustable in width by providing a rod with threaded ends which engage sockets defined in the ends of a split bit shank.

Consequently, none of the above inventions and patents, taken either singly or in combination, is seen to describe the instant invention as claimed, and therefore a horse bit assembly is with shank clips for interchangeable mouthpieces solving the aforementioned problems is desired.

SUMMARY OF THE INVENTION

The horse bit assembly with shank clips for interchangeable mouthpieces includes two cheekpiece shanks, an interchangeable mouthpiece and a curb chain. Each shank has a spring clip that allows one end of the mouthpiece to be easily removed and replaced without welding or having to manipulate several small nut and bolt assemblies. The clips have one end axially affixed to the shank and a free end having a hook which resiliently clips onto the shank. The mouthpiece is replaced by unclipping the fee end of the shank and sliding the eye at the end of the mouthpiece onto the shank, and re-attaching the hook to the shank. The curb chain helps to maintain the bit in an optimal position.

Accordingly, it is a principal object of the invention to provide a bit assembly that allows for quick and easy interchange of the mouthpiece by providing cheekpiece shanks with a clip which resiliently engages the shank.

It is another object of the invention to provide a bit assembly with shank clips for interchangeable mouthpieces that is adapted to receive interchangeable mouthpieces which have an eye at the ends for sliding onto the cheekpiece shank.

It is a further object of the invention to provide a bit assembly with shank clips for interchangeable mouthpieces which is capable of receiving a wide variety of mouthpieces of different types and sizes.

Still another object of the invention is to provide a bit assembly with shank clips allowing for the removal and replacement of its mouthpiece without having to manipulate nut and bolt assemblies.

Further, it is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
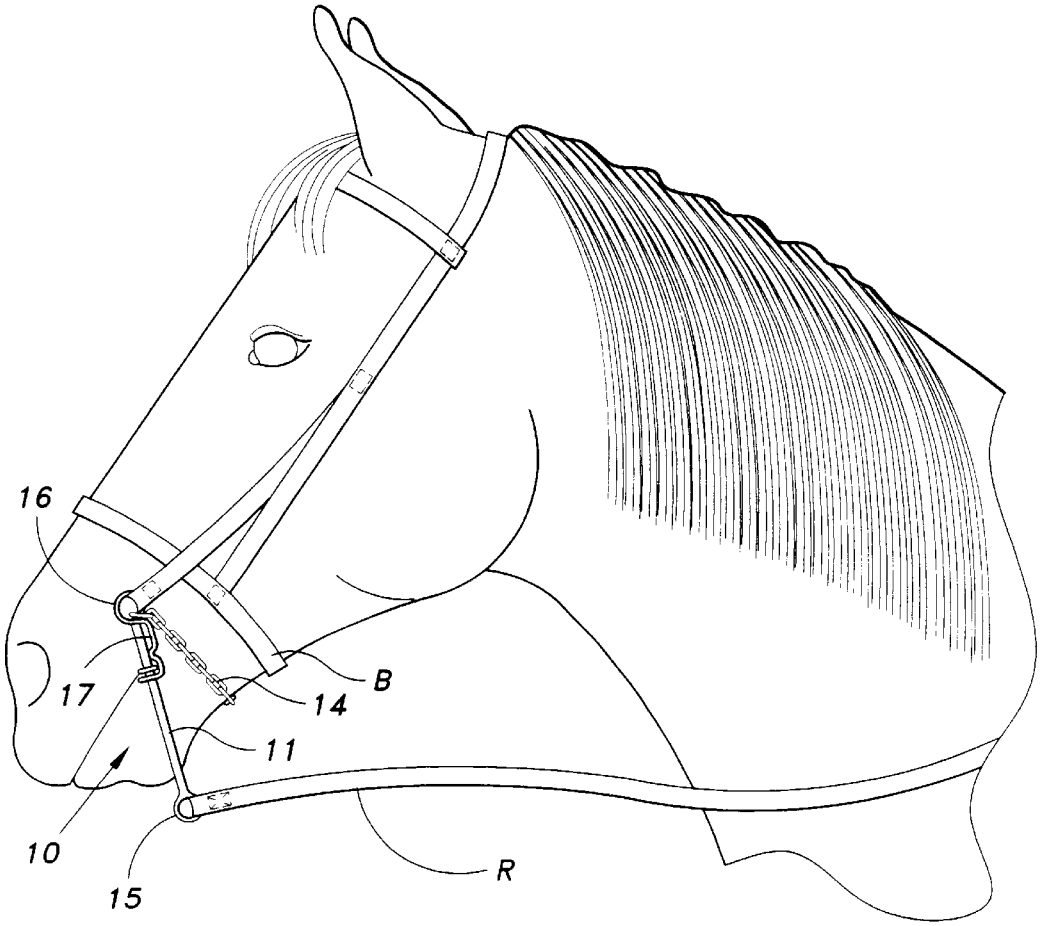
FIG. 1 is an environmental, perspective view of a horse bit assembly with shank clips for interchangeable mouthpieces according to the present invention shown on a bridled horse.
Figure 3:
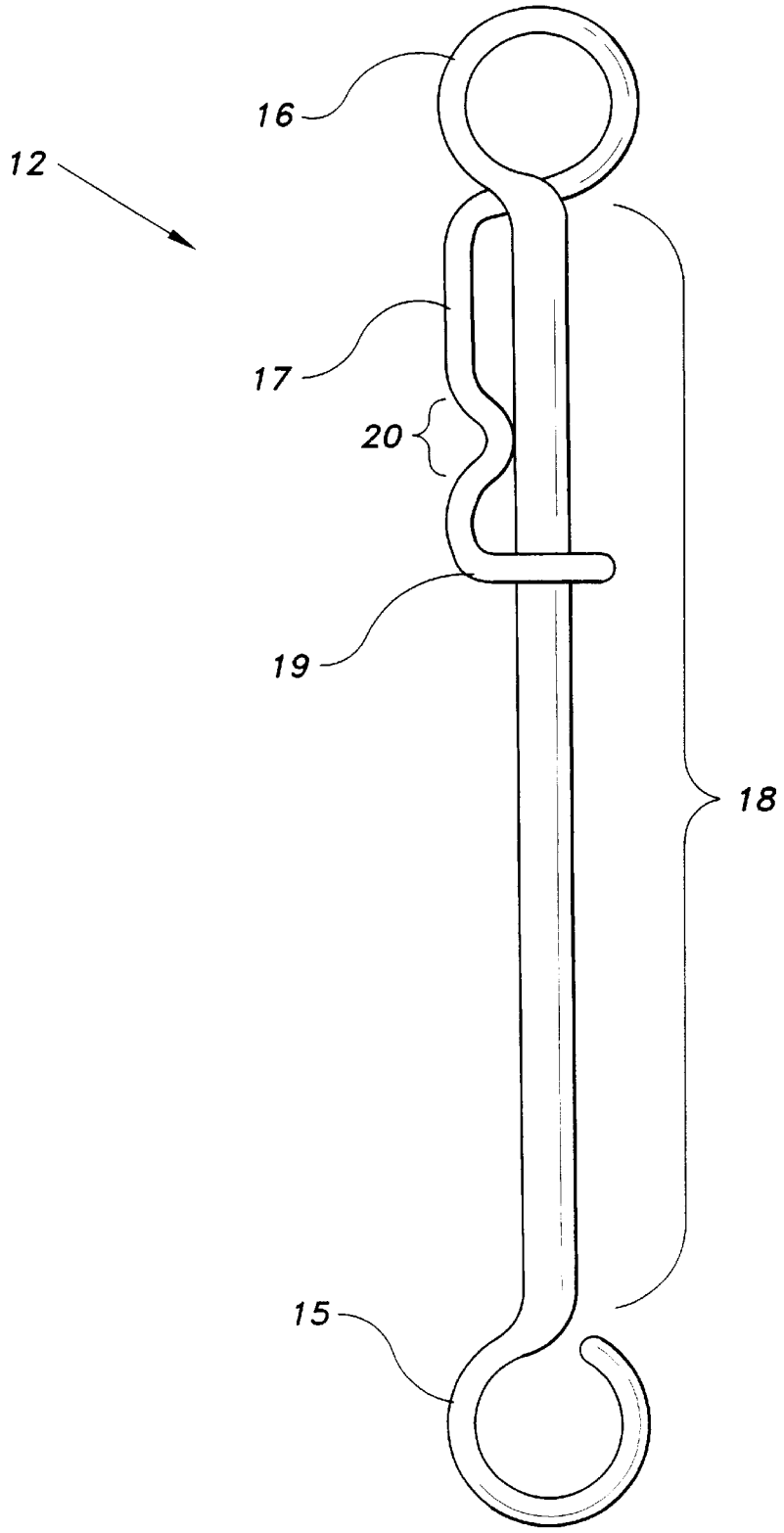
FIG. 3 is a front view of a shank for a horse bit assembly with shank clips for interchangeable mouthpieces according to the present invention.
Figure 4:
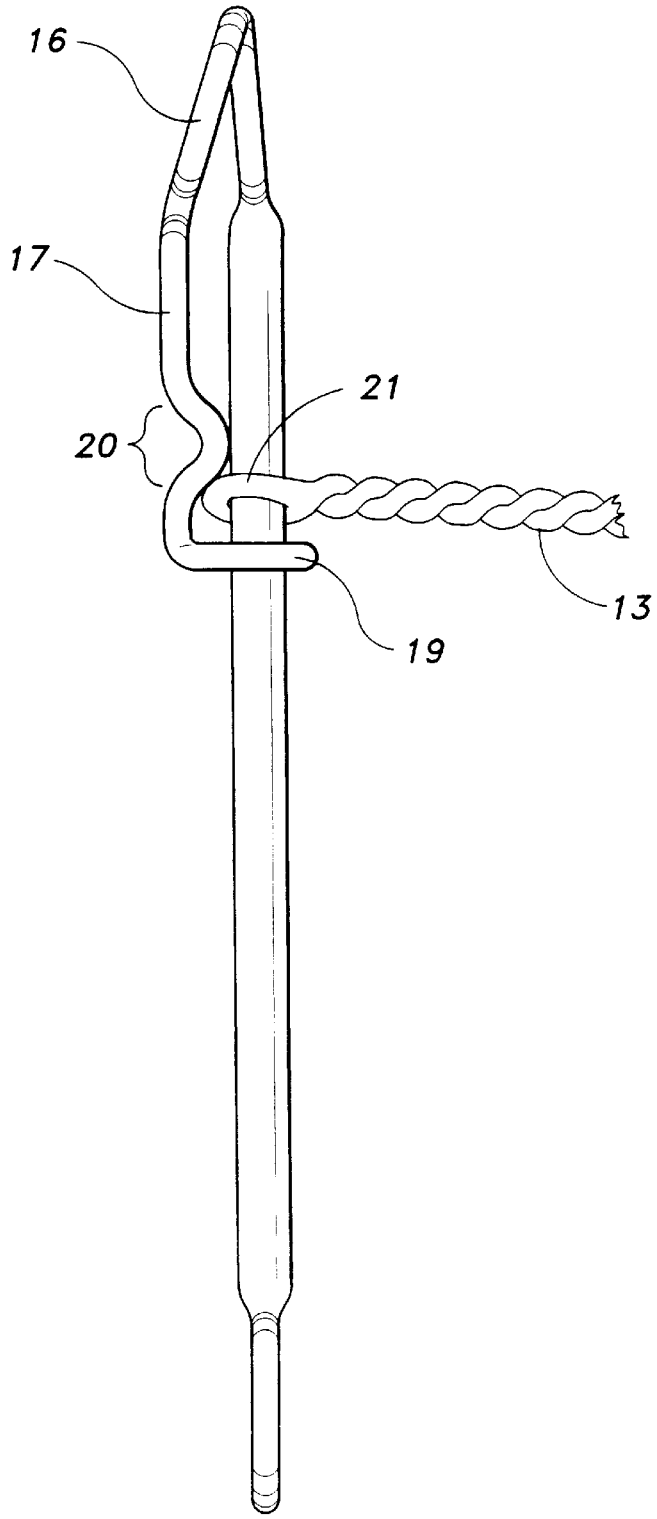
FIG. 4 is a fragmented side view of a shank for a horse bit assembly with shank clips for interchangeable mouthpieces according to the present invention.
Figure 5:
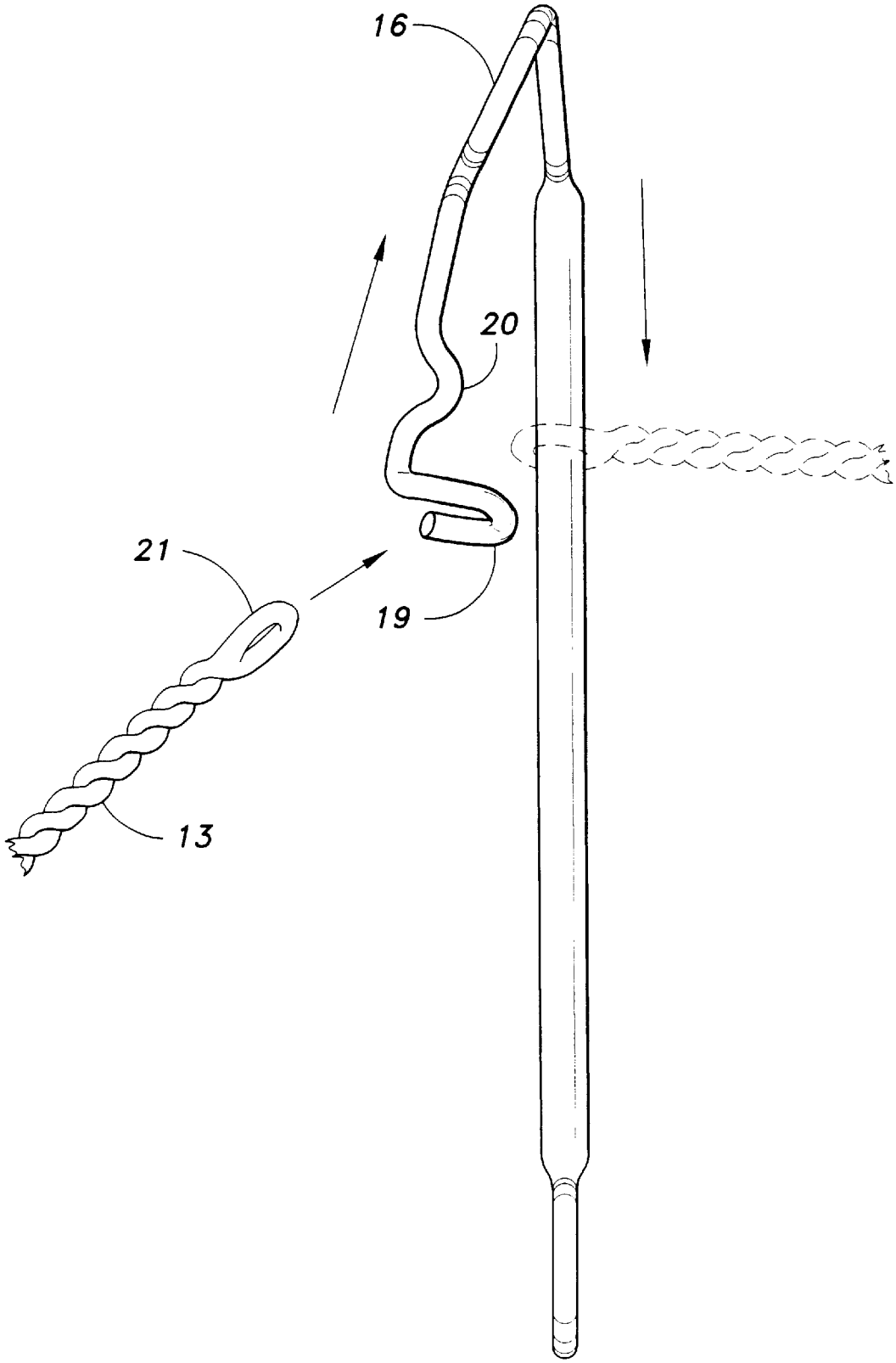
FIG. 5 is a side view of a shank for a horse bit assembly with shank clips for interchangeable mouthpieces according to the present invention shown with a fragmented mouthpiece and depicting the assembly of the mouthpiece to the shank.
Figure 6:
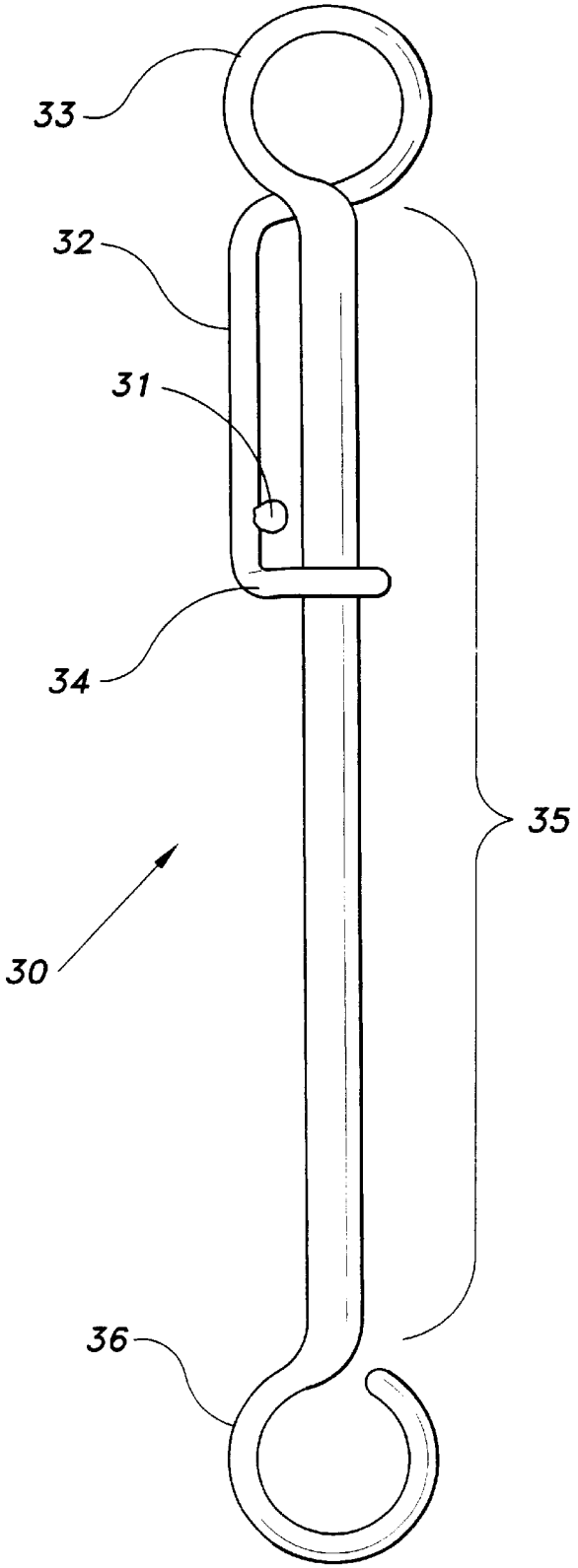
FIG. 6 is a front view of an alternative embodiment of a shank for a horse bit assembly with shank clips for interchangeable mouthpieces according to the present invention.
Figure 7:
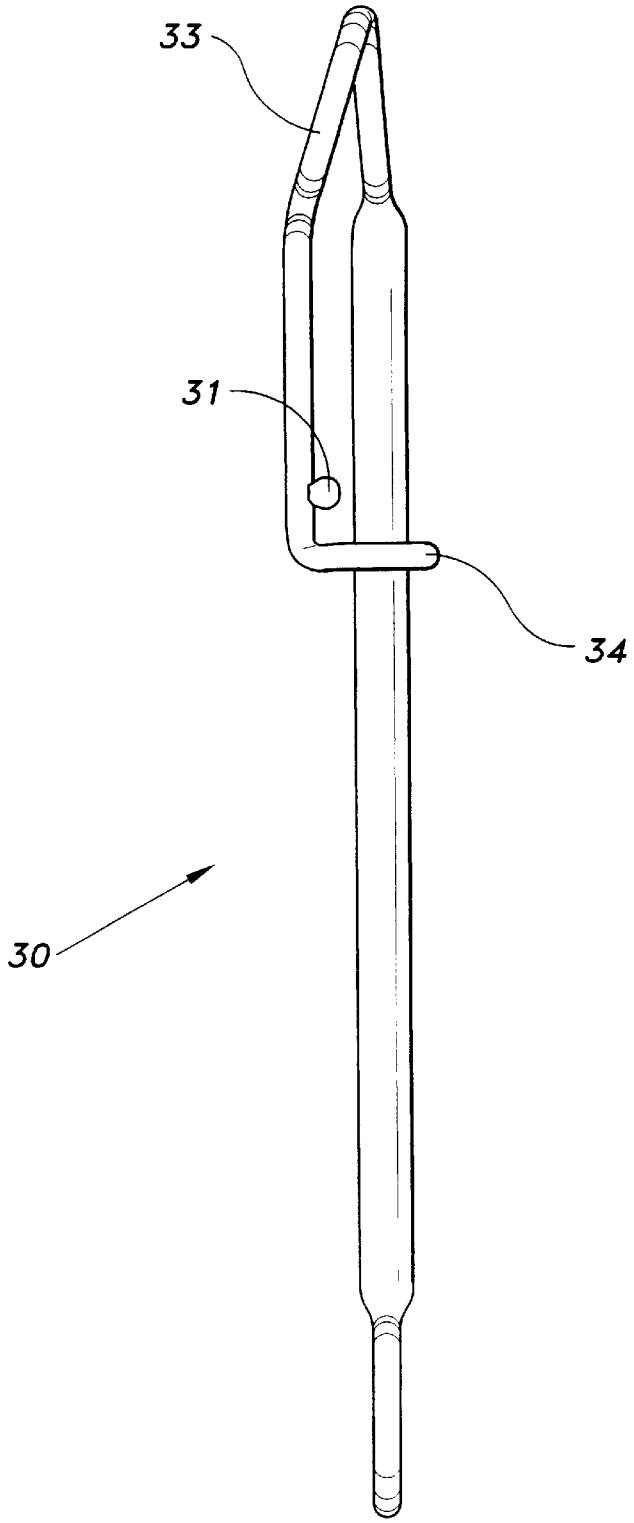
FIG. 7 is a side view of the alternative embodiment of a shank of FIG. 6 for a horse bit assembly with shank clips for interchangeable mouthpieces according to the present invention.

The present invention is a horse bit assembly 10 that uses clips to facilitate the quick and easy replacement of its mouthpiece. Referring, to the drawings, FIG. 1 illustrates the device 10 as worn on a horse, FIG. 2 illustrates the device 10 with its components properly assembled, FIGS. 3–5 illustrate a first embodiment of one of the shanks incorporated into the device, and FIGS. 6 and 7 illustrate a second embodiment of one of the shanks incorporated into the device 10.

Figure 2:
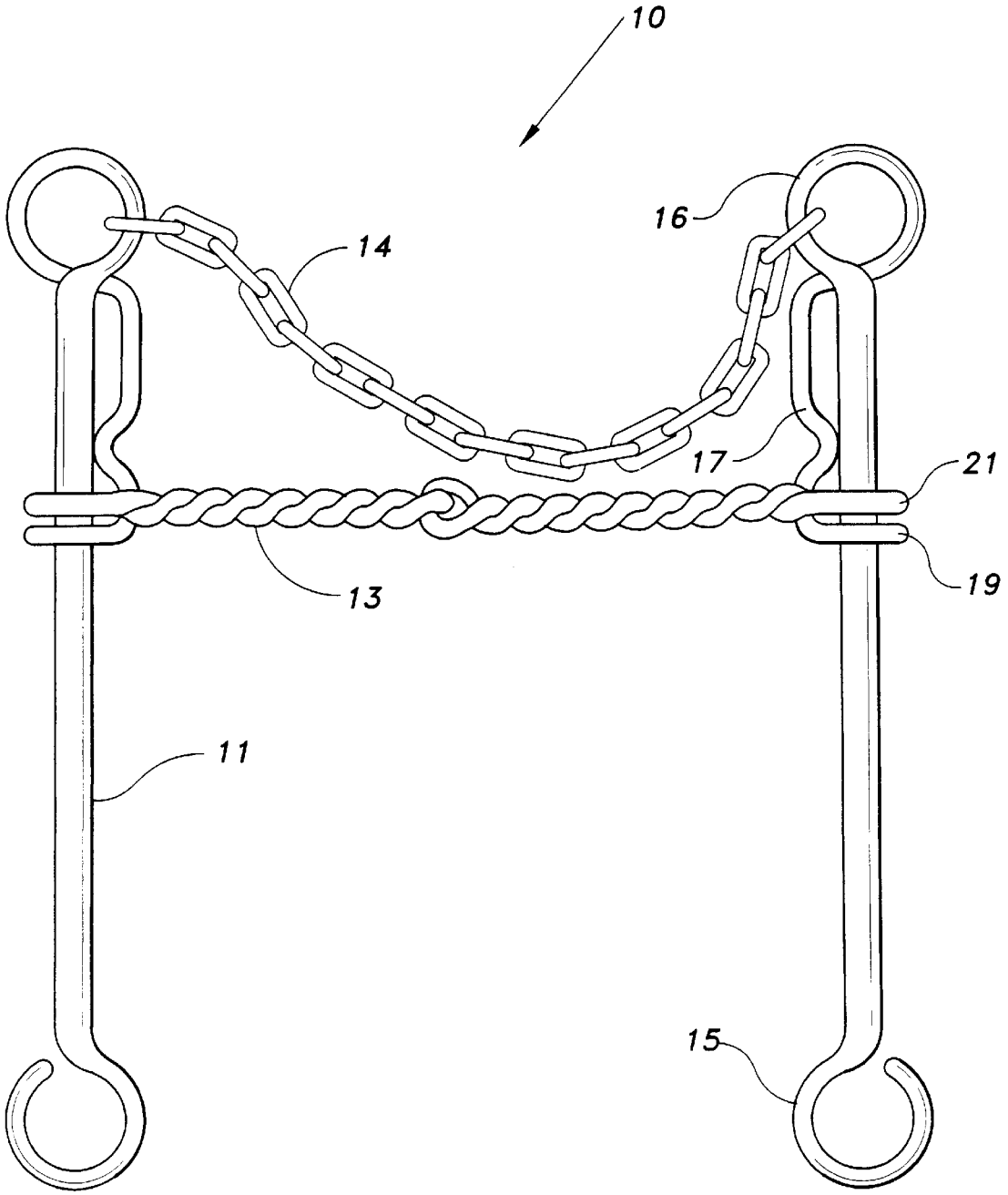
FIG. 2 is a front view of a horse bit assembly with shank clips for interchangeable mouthpieces according to the present invention.

The device 10 includes two cheekpiece shanks 11 and 12, a mouthpiece 13 and a curb chain 14, as shown in FIG. 2. Each shank 11 and 12, as shown in FIGS. 2 through 5, is a cylindrical rod that varies in thickness along it length. The lower end of rod is formed into a lower ring 15 and the upper end of the rod is formed into an upper ring 16 and clip 17. The lower and upper rings 15 and 16 are in the same plane. As shown in FIG. 3, the main body 18 of the shank 11 or 12 extends from its lower ring 15 to the upper ring 16 and the clip 17 extends from the upper ring 16 substantially parallel to the main body 18, with a distance of about ⅛ inch between the clip 17 and the main body 18. The end of the clip 17 has an end hook 19, as seen in FIG. 5, that wraps partially around the main body 18, where it is retained by spring tension. Above the end hook 19, the clip 17 has a U-shaped indentation 20 that bears against the main body 18 when the end hook 19 is positioned around the main body 18.

The clip 17 may be made in one piece with the shank 11 and 12 by casting, forging, or other metal fabrication process, or may be welded to the end of the upper rings 15 and 16, or the clip 17 may be formed in one piece with the upper rings 15 and 16, which are then welded to the main body 18. The clip 17 is resilient, so that when the hook 19 is disengaged from the main body 18, the clip 17 extends away from the main body 18, as shown in FIG. 5, but is capable of being compressed by pushing the clip 17 towards the main body 18 and engaging the hook 19 with the main body 18, where it is retained by spring tension, as shown in FIGS. 3 and 4.

The mouthpiece 13 has a mouthpiece ring or eye 21 at each of its two ends. Each end of the mouthpiece 13 is secured to a shank 11 or 12 by sliding the mouthpiece eye 21 onto the end hook 19 of the clip 17, up the clip 17 to the upper ring 16, around the upper ring 16 and down the main body 18, as shown in FIG. 5. When the end hook 19 is secured around the main body 18 such that the eye 21 is positioned between the end hook 19 and the point where the clip indentation 20 meets the main body 18, the mouthpiece eye 21 is secured in place and prevented from sliding up the main body 18 of the shank 11 or 12, as shown in FIG. 4.

It will be understood from the foregoing that the configuration of the mouthpiece 13 shown in the drawings is not critical, and that the horse bit assembly 10 of the present invention is capable of receiving a mouthpiece of any desired configuration (snaffle, curb, etc.), provided that the mouthpiece has an eye at opposing ends so that the mouthpiece eyes can slide over the hooks 19. The foregoing construction of the shanks 11 and 12 with spring clips 17 permits interchangeable mouthpieces to be quickly and easily substituted for one another in the horse bit assembly 10. It will also be understood that the configuration of the main body of each shank is not critical. While each shank is shown in the drawings having a main body that is substantially straight, the configuration of the main body can vary and, more specifically, can include one or more curves.

The curb chain 14 has two ends, each of which is attached to an upper ring 16 on a shank 11 or 12. The curb chain 14 has a length longer than that of the mouthpiece 13 such that, when the two shanks 11 and 12 are positioned parallel to each other with the mouthpiece 13 perpendicular to the shanks 11 and 12, the curb chain 14 is slack.

As shown in FIGS. 1 and 2, the device 10 is secured to the mouth of a horse by inserting the mouthpiece 13 into the horse's mouth with a shanks 11 and 12 disposed against each of the horse's cheeks. A bridal B is secured to the upper ring 16 of each shank 11 and 12, one end of the reins R being secured to each lower ring 15. Each end of the curb chain 14 is attached to an upper ring 16 with the curb chain 14 running under the horse's jaw. Thus, when the reins R are pulled the mouthpiece 13 applies pressure to the corners of the horse's mouth.

In an alternative embodiment of the bit assembly 10, the shank 30, shown in FIGS. 6 and 7, is substituted for shanks 11 and 12. Shank 30 is substantially identical to shanks 11 and 12, being a cylindrical rod having a ring 33 at the upper end and a second ring 36 at the lower end, and a spring clip 32 extending from the upper ring 33 downward and parallel to the main body 35 of the shank 30 and terminating in a hook 34 which resiliently engages the main body 35. The shank 30 differs from shanks 11 and 12 in that a nub 31 is substituted for the U-shaped indentation 20 in order to retain the mouthpiece 13 in proper position on the shank 30. The clip 32 is substantially straight from the upper ring 33 to its end hook 34 and the nub 31 protrudes from the clip 32 toward the main body 35 of the shank 30.

All components of the device 10 all constructed of metal.

It is to be understood that the present invention is not limited to the embodiments described above, but encompasses any and all embodiments within the scope of the following claims.

I claim:

1. A horse bit assembly with shank clips for interchangeable mouthpieces, comprising:

a first and a second cheekpiece shank, each shank having an elongated cylindrical body including an elongated main body having an upper end formed into an upper ring, a lower end formed into a lower ring, and a spring clip extending from the upper ring parallel to the main body, the clip having an end formed into a hook dimensioned for engaging the main body;

wherein the first shank and the second shank are dimensioned and configured for receiving an eye at opposing ends of a mouthpiece so that the mouthpiece eyes are adapted for sliding over the hooks, up the clip, around the upper ring, and being retained on the main body when the hooks are clipped onto the main body.

2. The horse bit assembly according to claim 1, further comprising a curb chain extending between the upper rings of said first and second cheekpiece shanks.

3. The horse bit assembly according to claim 1, wherein each said spring clip further comprises retaining means for preventing the mouthpiece eye from sliding back over the upper ring when said hook is clipped to the main body of said cheekpiece shank.

4. The horse bit assembly according to claim 1, wherein each said spring clip has a U-shaped indentation defined therein adapted for bearing against the main body of said cheekpiece shank, being adapted for retaining the mouthpiece eye on the main body between the indentation and the hook when the hook is clipped to the main body.

5. The horse bit assembly according to claim 1, wherein each said spring clip further comprises a nub projecting therefrom adapted for retaining the mouthpiece eye on the main body between the nub and the hook when the hook is clipped to the main body.

6. The horse bit assembly according to claim 1, wherein each of said first and said second shanks is made in one piece.

7. A cheekpiece for a horse bit assembly, comprising:

a shank having an elongated cylindrical body having an upper end and a lower end;

a lower ring extending from the lower end of said shank, the lower end being adapted for attachment of a rein;

an upper ring extending from the upper end of said shank, the upper ring being adapted for attachment of bridle straps and a curb chain; and a spring clip extending from said upper ring, the spring clip comprising an elongated shaft having an end defining a hook, the clip resiliently extending away from the shank when the hook is disengaged from the shank, and being compressible in order to extend parallel to the shank when the hook is clipped onto the shank;

wherein the cheekpiece is adapted for sliding an eye of an interchangeable mouthpiece over the hook, around the upper ring, and onto the shank, the mouthpiece being retained on the shank when the hook is clipped onto the shank.

8. The cheekpiece according to claim 7, wherein said spring clip further comprises retaining means for preventing the mouthpiece eye from sliding back over the upper ring when said hook is clipped onto said shank.

9. The cheekpiece according to claim 7, wherein said spring clip has a U-shaped indentation defined therein adapted for bearing against said shank, being adapted for retaining the mouthpiece eye on the main body between the indentation and the hook when the hook is clipped onto said shank.

10. The cheekpiece according to claim 7, wherein said spring clip further comprises a nub projecting therefrom adapted for retaining the mouthpiece eye on the main body between the nub and the hook when the hook is clipped onto said shank.

11. The cheekpiece according to claim 7, wherein the cheekpiece is made in one piece.

* * * * *